US005134741A

United States Patent [19]

Carcassi

[11] Patent Number: 5,134,741

[45] Date of Patent: Aug. 4, 1992

[54] BRIDGE STRUCTURE PREFABRICATED WITH POSITIVE IMPRINT END PANELS

[76] Inventor: Marco Carcassi, Via N. Bixio No. 17, Pisa, Italy

[21] Appl. No.: 541,157

[22] Filed: Jun. 20, 1990

[30] Foreign Application Priority Data

Jun. 21, 1989 [IT] Italy ..... 9458 A/89

[51] Int. Cl.[5] ..... E01D 19/00

[52] U.S. Cl. ..... 14/14; 264/33; 249/21; 425/65

[58] Field of Search ..... 14/1, 17-19, 14/23, 13, 14, 16.5, 24, 73; 52/33, 79.4, 79.9, 79.12, 421, 431-433, 436, 448, 509, 574, 578, 745, 747, 230, 243, 227-229, 143, 174, 731; 264/33-34; 425/63, 65; 249/21, 50, 99, 101, 209

[56] References Cited

U.S. PATENT DOCUMENTS

| | | | |
|---|---|---|---|
| 3,367,074 | 2/1968 | Vanich | 52/174 |
| 3,906,687 | 9/1975 | Schupack | 52/223 |
| 3,977,149 | 8/1976 | Hayes et al. | 52/731 |
| 4,201,020 | 5/1980 | Saunders | 52/745 |

*Primary Examiner*—Terry Lee Melius
*Assistant Examiner*—Roger J. Schoeppel
*Attorney, Agent, or Firm*—McGlew & Tuttle

[57] ABSTRACT

The method comprises: the prefabrication of pairs of frames (21, 23) having a shaped surface (25) in order to form, in two contiguous segments or blocks (11), matched coupling surfaces for perfect in situ coupling; the arrangement of a plurality of spaced pairs of frames (21, 23) in a formwork apparatus for concrete castings; the simultaneous formation, in said apparatus, of a plurality of contiguous segments or blocks, each incorporating a frame (21; 23) at both ends, and each having an end surface (25) perfectly matched with the abutting surface of the contiguous segment or block.

15 Claims, 5 Drawing Sheets

BRIDGE STRUCTURE PREFABRICATED WITH POSITIVE IMPRINT END PANELS

FIELD OF THE INVENTION

The construction of bridges in prestressed reinforced concrete has in this last decade been characterized by a substantial development of the structural procedure based on matched prefabricated blocks.

BACKGROUND OF THE INVENTION

As is known, two structural procedures are at present used to produce the matched prefabricated blocks.

The first known structural procedure is carried out (see FIG. 1) by employing a special formwork CF which is used to construct one block at a time, using a fixed metal head TM to cast the blocks one after the other, having a patterned surface SM to produce the coupling surfaces of the blocks; the previous, already prefabricated block is used as a counter-caisson. Co designates a previous block which has already been cast and cured, and which is distant from the head TM by an amount equal to the length of the blocks; CX designates the subsequent block under construction, delimited by the block Co and by the surface SM. When the block Cx has been cast, and when the concrete of the latter has cured and has reached the requisite strength, the block Co is removed to the site provided for storage, while the block Cx is displaced to where the block Co formerly was, in a manner such as to be used for the casting of the subsequent block, and so on. Because of the necessity of allowing the casting to cure for at least about a day, the rate of progress is only one block per day. Furthermore, it is necessary to resort to the arduous correction of the blocks, since inevitable deformation of the formwork takes place during casting, so that each individual block always exhibits certain deviations from the theoretically envisaged dimensions; correction is carried out by imparting to the subsequent block a deformation such as to produce a complementary error which cancels the error in the previous block. This correction of the blocks is very arduous and unreliable.

The second known structural procedure envisages (see FIG. 2) the use of a prefabrication bed LF where the individual blocks C1, C2 . . . CN are cast one after the other by means of a mobile formwork which is caused to slide in the direction fC on suitable rollers formed in the bed LF. In this case, correction of the blocks is not necessary, but production is still at the rate of a single block per day, and the apparatus is very cumbersome.

SUMMARY AND OBJECTS OF THE INVENTION

The invention relates to a novel method of prefabrication and also to an apparatus for carrying it out, which avoid the disadvantages of the methods currently in use, and in particular achieve: speed of production; continuous casting of the blocks and curing (without solution of continuity); uniform physical and mechanical properties of the various segments or blocks. These and other objects and advantages will become apparent from the text which follows.

The method in question for the prefabrication of bridges—both spans and piles—and similar structures comprises the formation, away from site, of segments or blocks forming at least a portion of the structure. For perfect coupling of contiguous segments or blocks, the method according to the invention comprises: the prefabrication of endplates or frames having a shaped surface in order to form, in two contiguous blocks or segments, matched coupling surfaces for perfect in situ coupling; the arrangement of a plurality of spaced endplates or frames in a formwork apparatus for concrete castings; the formation, in said apparatus, of a plurality of contiguous blocks or segments, each incorporating an endplate or frame at one or both ends, and each having an end surface perfectly matched with the abutting surface of the contiguous block or segment. Casting is carried out continuously, without the need for interruptions. The various segments thus formed are placed in situ in the same relative positions in which they were formed in the formwork apparatus.

According to a possible embodiment, one of the shaped and matched surfaces of contiguous blocks or segments is formed by a prefabricated endplate or frame, and the other is formed by the casting and modeled on the shaped surface of said endplate or frame, which surface is advantageously provided with a separation agent.

According to another possible embodiment, two endplates or frames are prefabricated with their surfaces mutually matched, and a plurality of pairs thereof are placed at a distance apart in the formwork apparatus in order for the frames to be incorporated in the facing ends of the contiguous blocks or segments.

In order to form the segments or blocks, further prefabricated elements may be used, as a result of which the volume of in situ castings is limited to portions in the zones contiguous to the end frames or plates in order to incorporate therein the projecting reinforcements, and in the zones intended to form the distribution slab in the segments or blocks intended for the production of a bridge span.

The formwork apparatus may be deformed from time to time—as a rule elastically and/or by means of play between the components thereof, and with the aid of screwed supports or the like—in order to correspond to the alignment of the structural portion to be prepared with the segments molded by continuous casting in said apparatus.

It is also possible to envisage the prior arrangement, in the prefabricated frames or endplates and in the segments or blocks which incorporate them, of seatings and passages for cables and other members to be arranged in situ.

Another subject of the invention is an apparatus for forming, away from the site, segments or blocks constituting at least a portion of a structure produced by the method described above. Said apparatus is developed over an extent equal to that of the structure or of the portion of structure to be produced, and is capable of receiving a plurality of prefabricated frames or endplates, intended to be incorporated into ends of contiguous segments to be formed in said apparatus, and of receiving internal formwork portions to define the individual segments to be formed. This apparatus may also comprise a plurality of individually adjustable support elements in order to impose, from time to time, controlled deformations of said apparatus, corresponding to the alignment of the structure or of the portion of a structure to be produced with the segments created in said apparatus.

Another, further subject of the invention is a prefabricated frame or endplate possessing an extent at least equal to that of the cross-section of a segment or block, and a reinforcement projecting to be incorporated in the casting of said segment or block formed away from the site; the endplate forms one end of the segment or block; the endplate or frame possesses a shaped surface in order to form matched surfaces for coupling said segment to the surface created on a contiguous segment; the two matched surfaces are formed one on the other.

Another subject of the invention is a pair of prefabricated frames or endplates, produced with perfectly matched shaped surfaces—one being modeled on the other which was formed previously—and each possessing a reinforcement projecting in the opposite direction to its own shaped surface; said two endplates or frames are capable of being placed as a pair in a formwork apparatus in order for each to be incorporated into the end of one of the two segments cast in said apparatus, one contiguous to the other.

Another subject of the invention is a segment or block formed, away from the site, for producing a bridge or other structure having a plurality of such segments, which segment or block comprises, at least at one end for coupling to a contiguous segment in situ, a prefabricated frame or endplate as defined above, incorporated into said segment to form the matched surface for coupling the latter to a contiguous segment in situ. In a single segment or block, both ends may incorporate a prefabricated frame or endplate. The segment or block may comprise additional components which have been prefabricated and assembled with the casting away from the site.

BRIEF DESCRIPTION OF THE DRAWINGS

The invention will be better understood with reference to the description and the attached drawing, which shows a practical, non-limiting exemplary embodiment of said invention. In the drawing.

DETAILED DESCRIPTION OF THE PRIOR ART

According to what is shown in FIGS. 3 to 9, 11 designates mutually contiguous blocks which are produced in a single casting operation, according to the method of the invention; the plurality of blocks 11 is developed over a length L equal to that of one bridge segment or span, or of one bridge section whose blocks may be cast simultaneously.

Figure 1:
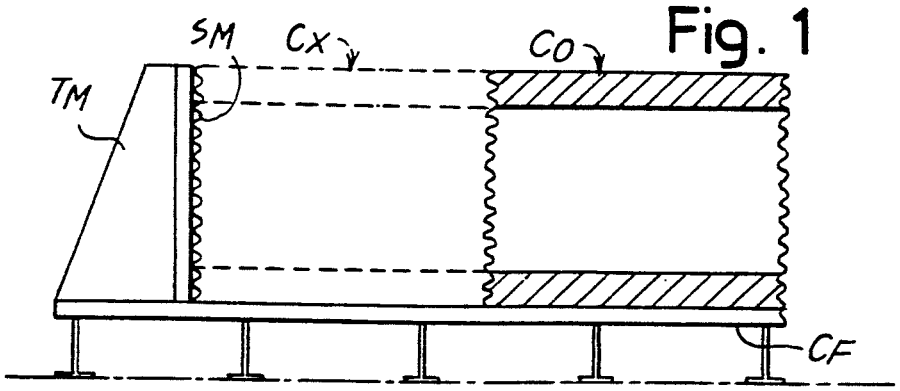
FIGS. 1 and 2 show the conventional solutions already mentioned.
Figure 2:
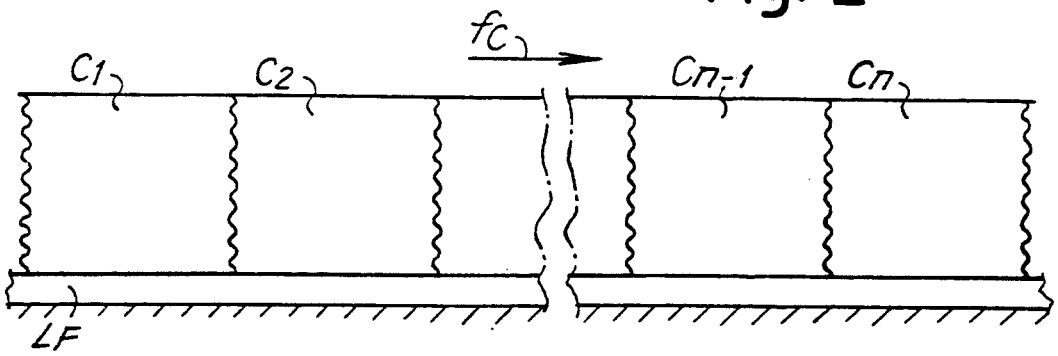
Figure 3:
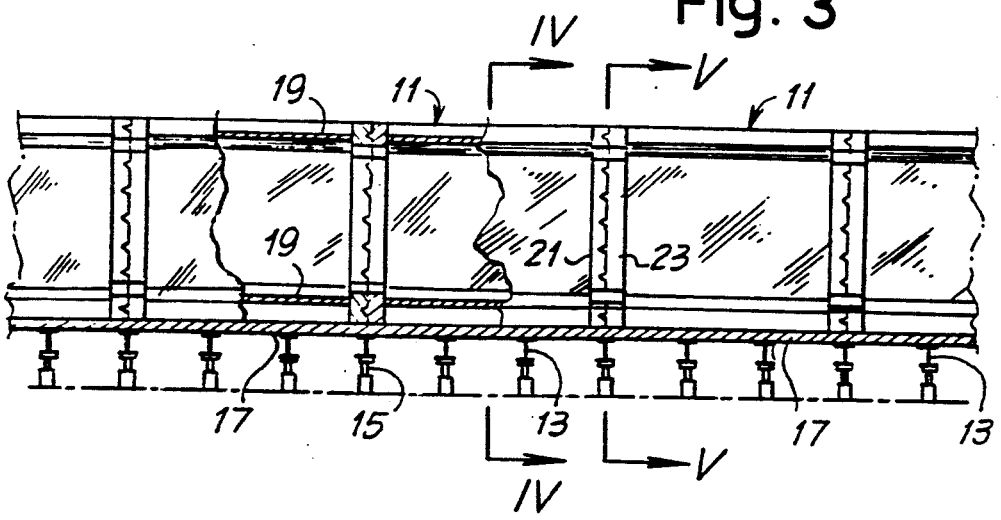
FIG. 3 shows a diagrammatical longitudinal section through a formwork complex for the formation of blocks relating to a bridge section to be cast in simultaneous operation.
Figure 4:
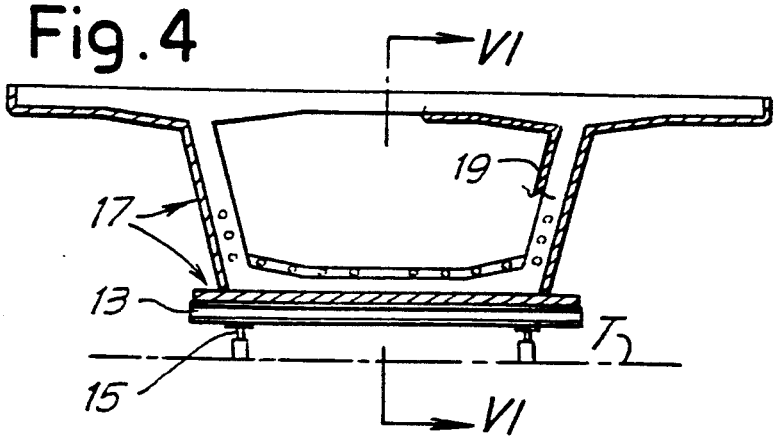
FIGS. 4 and 5 show a cross-section along IV—IV and V—V to illustrate a formwork and one of the prefabricated frames having a shaped surface.

The formwork for casting the series of blocks 11 is formed by base cross-pieces 13 supported by supports 15 on the ground T, in order to support an outer formwork 17 formed by coupled sections of various lengths, which lengths may be substantially different from those of the blocks 11; the formwork 17 is open at the top to allow for the casting of the slab, and arranged within said formwork is a segmented formwork 19—only part of which is visible in FIG. 4—which is expediently positioned relative to the formwork 17 so as to leave a space for the casting to be carried out. The segments of the inner formwork 19 advantageously correspond to the individual blocks to be cast. The adjustable supports 15 and the restrictedly flexible structure of the formwork complex make it possible to modify the attitude of the formwork and hence the conformation of the bridge segment or span of length L which is to be cast, in accordance with the requirements of the design, which may also require modifications in the conformation of the bridge segment.

Figure 5:
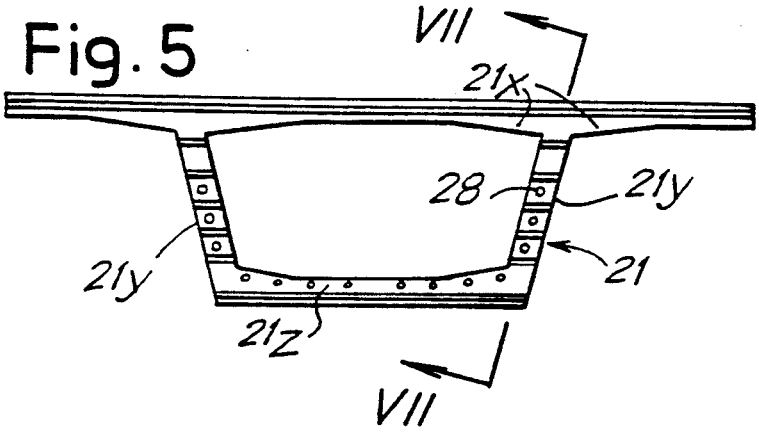

The formwork 17, 19 is produced in such a manner as to obtain the lower slab, the structure having spaced longitudinal ribs, and the upper slab. In order to form the casting in continuous operation for all the blocks, and to obtain the separation of the blocks 11 produced by means of the substantially uniform and simultaneous casting, use is made of prefabricated endplates or frames 21, 23 which match perfectly to avoid concentrations of forces, that is to say having coupling surfaces 25 which are shaped in a complementary manner with ribs and recesses (usually horizontal) in order to obtain coupling without any possibility of slippage in the coupling plane. The endplates or frames 21 and 23 have a cross-section which corresponds to that of the blocks, substantially as shown in FIG. 5, with a horizontal zone 21X at the level of the slab, connecting sections 21Y and a lower zone 21Z for connecting the lower ends of the sections 21Y. From the surfaces of each endplate or frame 21, 23 which are opposite to the matched coupling surfaces 25 there extend linking straps 26 connected to the reinforcement provided in each of the frames 21, 23 to provide the connection to the reinforcements and to the casting of the block to be formed in the formwork 17, 19.

One of the two endplates or frames 21, 23 is formed with a horizontal formwork having a patterned surface; the other of said endplates or frames is cast against the patterned surface of the first endplate or frame, which has been reversed, a suitable separation agent being present on the surface 25 of the frame first cast. The apparatus of the formwork may be pivotable and tiltable.

The two prefabricated and matched endplates or frames 21, 23 are coupled by their surfaces 25, and a plurality of pairs of frames 21, 23 are positioned along the formwork 17, at distances such that the surfaces 25 are spaced equal to the longitudinal dimension of the blocks 11 to be formed; the straps 26 are naturally folded down into the space between pairs of endplates 21 and 23. There then follows the in situ casting 300 of all the blocks forming the lower slabs (at the level of the zones 21Z), then—the inner formworks 19 having been positioned in good time—those forming the sides (at the level of the zones 21Y) and then those forming, at the top, the slabs corresponding to the zones 21X. The casting 300 may incorporate suitable reinforcements, positioned in good time in the formworks and interacting with the straps 26 of the endplates or frames 21 and 23. Sheaths for various purposes may readily be incorporated in the castings 300, including sheaths combined with passages such as passages 28 formed in the frames 21, 23.

After the castings have cured—which takes place in a single interval—the individual blocks, defined at the ends by a frame 23 and by a frame 21, can be separated and are fully ready to be placed in situ.

Instead of forming the blocks by in situ casting, simply with the presence of the prefabricated frames 21 and 23, it is possible to envisage the use of prefabricated sections to be incorporated with the extemporary in situ castings. This simplifies the operations, and the conformation of the formworks.

Figure 10:
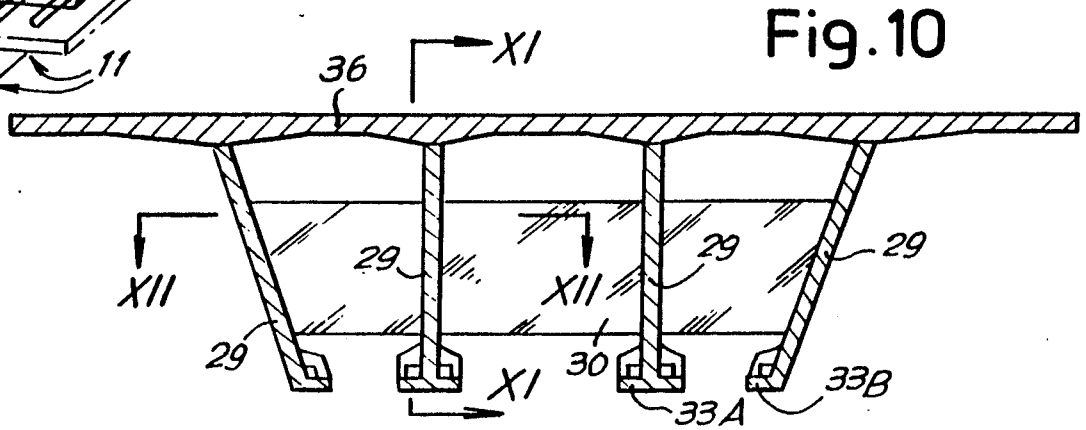
FIG. 10 shows a cross-section through a block according to a different embodiment.
Figure 11:
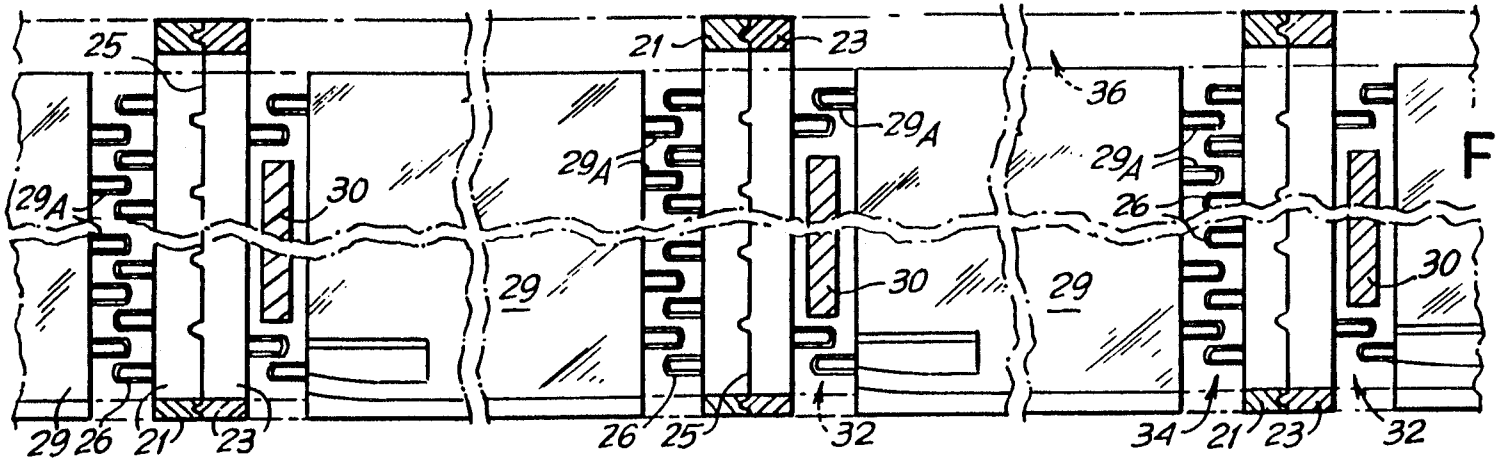
FIG. 11 and 12 show two sections along XI—XI and XII—XII in FIG. 10, illustrating contiguous blocks.
Figure 12:
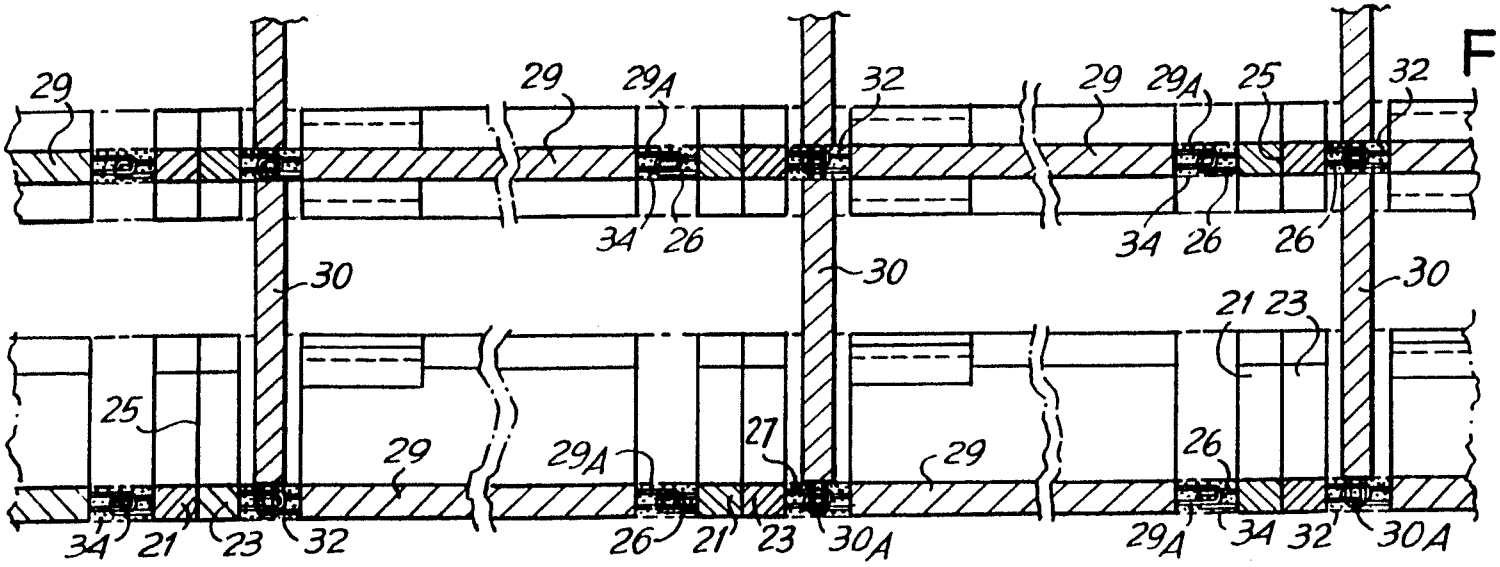

FIGS. 10 to 12 show an embodiment which envisages the insertion of further prefabricated elements which form the greater part of the longitudinal ribs supporting the slab, and also transverse connecting shutters between the ribs. Prefabricated panels 29 form portions of the longitudinal ribs of the structure of the bridge, while prefabricated panels 30 interact with the formation of transverse shutters by means of straps 30A. The longitudinal panels 29 possess reinforcing straps 29A projecting from the panel and connected to the actual reinforcement 27 of the frame 21 or 23. The straps 29A project both laterally and at the top in order to be embedded in sealing castings 32 and 34 which are made in the formwork (which may be limited by the presence of the prefabricated panels 29 and 30) in line with relatively restricted spaces between the panels 29 and the frames 21 and 23; these sealing castings incorporate both the straps 26 of the frames 21 and 23 and the straps 29A of the panels 29, together with any straps 30A of the transverse panels 30. The sealing castings, generically designated 32 and 34, are completed by the casting of the upper slab 36. The castings 32 are formed at the level of the position in which are situated the transverse panels 30 for the formation of the transverse shutters, for which purpose the castings 32 incorporate the straps 26, the straps 29A and also straps 30A projecting from the reinforcements of the panels 30. In this embodiment, the casting is limited to the parts 32, 34 and to the slab 36, which is always and entirely cast in situ, with the exception of the endplates or frames 21, 23. Both the longitudinal panels 29 and the castings 32, 34, like the frames 21 and 23, may possess expanded portions such as the portions 33A, 33B in FIG. 10.

The individual blocks 11, defined at the ends by the frames 21 and 23, can be separated one from the other immediately after the curing of the casting continuously formed for the seals 32, 34 and for the slab 36, after the simultaneous curing of all the connecting parts, cast in situ, of the blocks contained in the length of the formwork; all the blocks can be maneuvered separately to be placed in situ.

Figure 13:
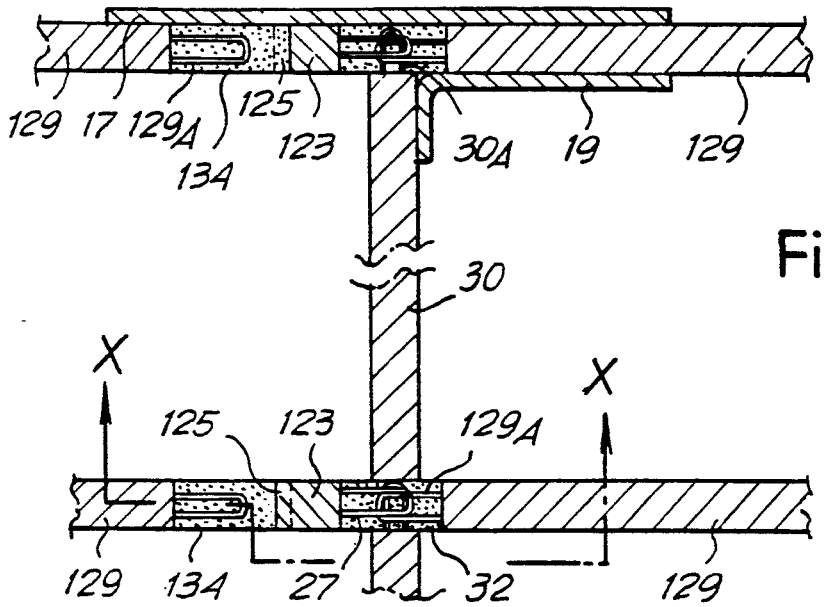
FIGS. 13 and 14 show an alternative embodiment.
Figure 14:
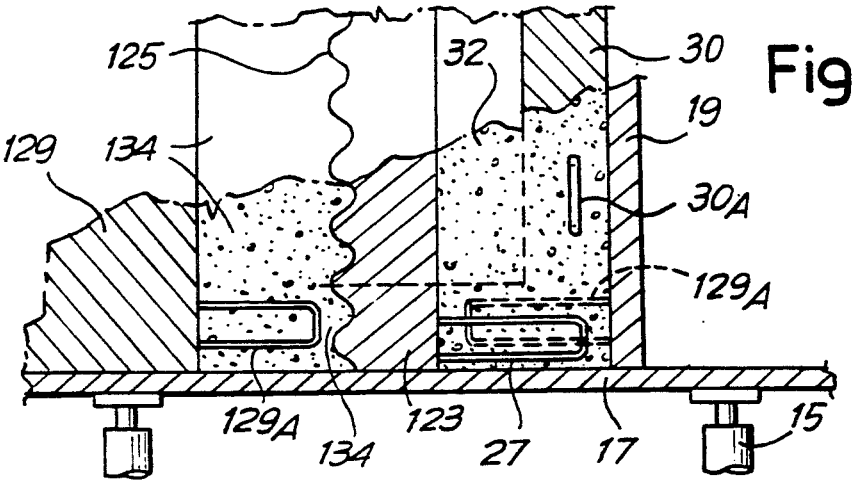

According to the alternative embodiment shown in FIGS. 13 and 14, instead of pairs of endplates or frames 21 and 23 being provided, having matched coupling surfaces 25, a single frame 123 is provided, having a surface 125 which is shaped like the matched surfaces 25 of the two frames of the preceding examples, and having straps 27. In this modified arrangement, the surface matched to the surface 125 can be obtained by means of an in situ sealing casting 134 (in the formwork) which creates the structural portion previously formed by the sealing casting 34 and by the frame 21, with the feature that the surface 125 of the frame 123 is subjected to an appropriate treatment with separation agents. In this case, straps 129A extending from the longitudinal panels 129 contiguous to the casting 134 (and equivalent to the straps 30 in the preceding case) are extended in the casting 134 as far as the vicinity of the matched coupling surface 125, and the casting 134 may also be completed with any appropriate reinforcements embedded in said casting. For the remainder, the arrangement corresponds to that in the preceding examples.

Figure 6:
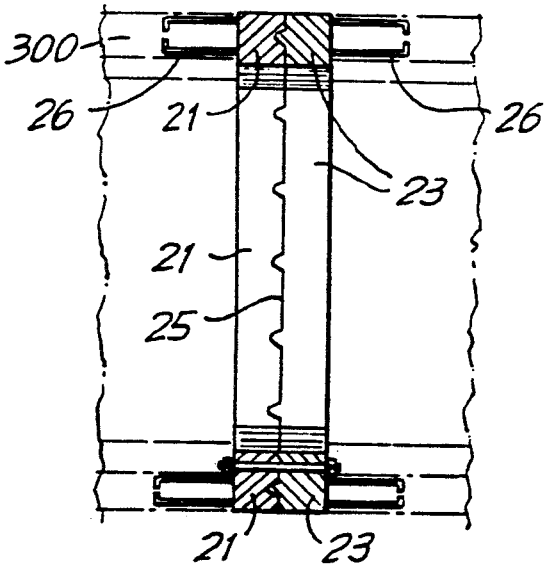
FIGS. 6 and 7 show local sections along VI—VI in FIG. 4 and VII—VII, in FIG. 5.
Figure 7:
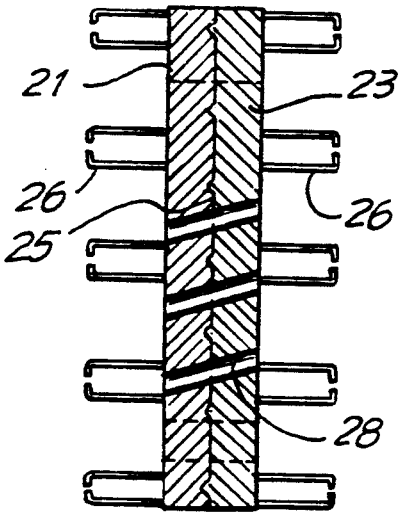
Figure 8:
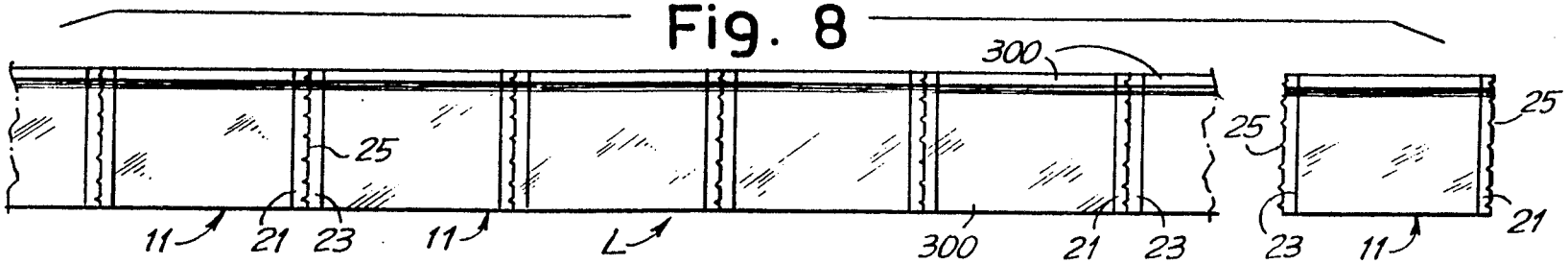
FIG. 8 shows a schematic lateral view of a bridge section already in situ and an isolated block.
Figure 9:
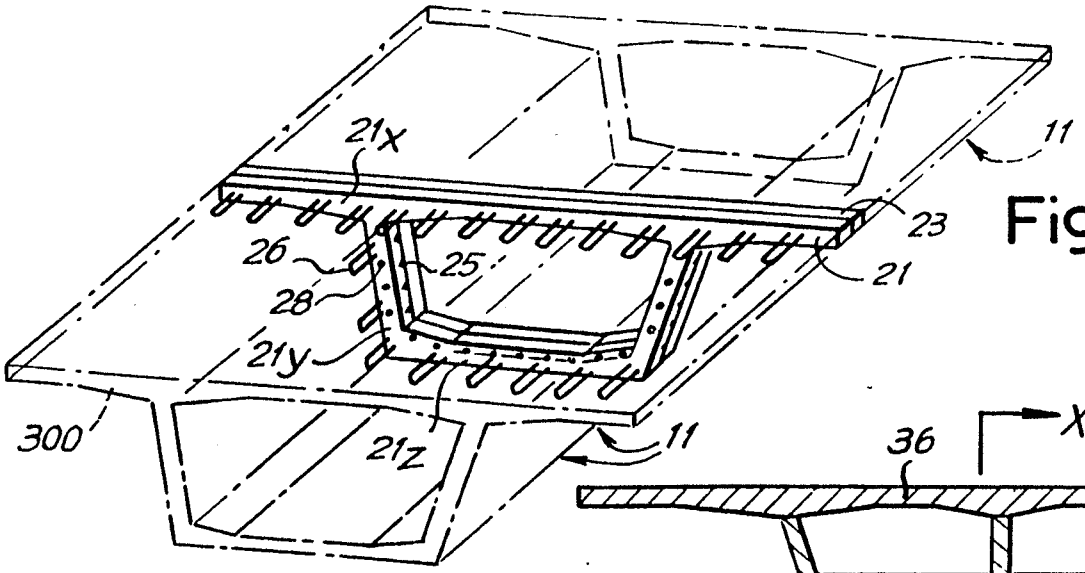
FIG. 9 shows an axonometric view of a pair of prefabricated coupling frames and, in broken lines, the castings contiguous thereto.
Figure 15:
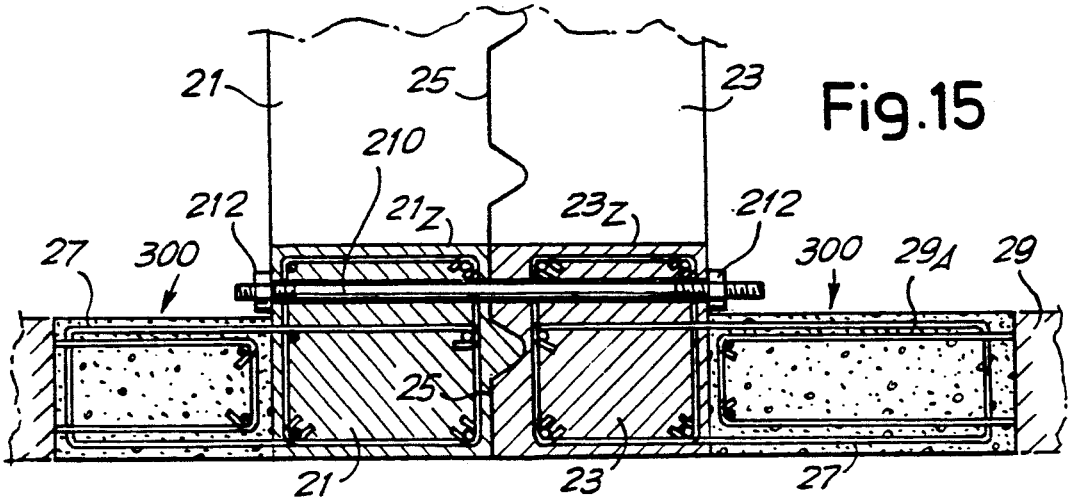
FIG. 15 shows an enlarged detail of FIG. 6.

In the detail shown in FIG. 15, which is an enlargement from FIG. 6, it will be noted that the zones 21Z and 23Z are of larger dimensions than the part of the casting 300 which forms the lower slabs, so as to project inwards. In this case, it is possible to make use of coupling rods 210 which are accommodated in the parts 217 and 237 of the thickness of the frames 21 and 23 which projects from the casting 300. It is thus possible to bring about a mechanical coupling by means of said coupling rods 210, with which nuts 212 are combined, to obtain a tensile strength in the joints of the manufactured article, specifically of the same order of magnitude as the flexural strength of the blocks.

All the panels, the frames and the castings may be combined with passages and seatings for the final reinforcement to be provided in the structure obtained by the placing of the various blocks in situ. The metal reinforcements for the blocks or segments will be before casting, as will the sheaths for the cables, and the whole may be at least partly prearranged in the prefabricated manufactured articles such as the prefabricated frames 21, 23 and the panels 29. The arrangement can easily be achieved precisely, in a manner such that the various seatings for the final reinforcement are perfectly positioned in situ, the matched coupling surfaces being accurately prearranged.

It may be noted that, before casting, it is easily possible to control—by acting on supports 15 or equivalent supports—the exact longitudinal and transverse configuration of the bridge section which is to be produced by means of the blocks cast in said formwork; the configuration can readily be adjusted by acting on the lower regulating screws 15, which support the formwork and make it possible to model said formwork with limited relative displacements, taking advantage of the elasticity and the possibility of play between the various components of the formwork.

The casting of the concrete of the entire section or segment of the bridge takes place in a single interval, the pairs of frames or individual frames and, if appropriate, the longitudinal and transverse panels, which are prefabricated like the frames, being incorporated. Curing—specifically steam curing—of the entire bridge section just cast is carried out in a manner such as to obtain virtually uniform and simultaneous curing of all the segments or blocks which constitute the section produced, away from the site, by means of the method in question. The segments or blocks are dismantled one by one and transported to the place where they will be assembled, in situ, by means of conventional systems.

The outer formwork segments may also be of lengths which are different from—and specifically greater than—those of the prefabricated segments or blocks to be obtained with the aid of the castings and prefabricated manufactured articles indicated above.

The present method offers, inter alia, the following advantages:

Considerable speed of production, since the casting of the concrete which is necessary for the segments or blocks of each span takes place in a single, simultaneous operation; this also applies to the steam curing;

The physical and mechanical properties of the concrete of all the segments or blocks which make up each individual span are identical;

It is not necessary to correct the individual segments successively cast (as happens at present) since, before casting, the planimetric and altimetric position of the metal formwork can be accurately and easily checked, with no solutions of continuity. In practice, the situation is as if the bridge were cast in situ in the prefabricating workshop and then dismantled, segment by segment, and reassembled at the assembly site to form the new span;

The use of at least one prefabricated frame or of pairs of matched frames, previously prefabricated in particularly strong concrete, ensures, inter alia, the perfect matching of the surfaces in contact during the formation of the blocks or segments, thus facilitating the insertion of the tendons in the sheaths and preventing the loss of mortar during the injections of cement into the sheaths;

Causing the frames to project by even a few centimeters inside the box section (see FIG. 8) provides an excellent support point for fixing the panels of the inner formwork, and makes dismantling it easier;

On the lower inner bossage (such as the bossage 21Z) of the prefabricated frames it is also possible to provide holes which, after the construction of the bridge, will be able to be used for the introduction of threaded steel rods 210, which will help to raise the moment of resistance of the section and to reduce the flexibility of the continuous beam. This circumstance is particularly valuable for bridges constructed with external cables;

The use of the prefabricated and matched frame or frames cancels the effect of longitudinal shrinkage of the concrete, and hence it is possible to use, without reservation, very high-strength concretes (1000 $kg/cm^2$) and above, obtained, for example, with the use of superplastifiers and silica fume, which are particularly sensitive to the shrinkage effects. This circumstance is also particularly valuable for bridges with external cables and a lightened section.

The method is also particularly economical for the construction of the piles of bridges made with prefabricated segments.

The method of using prefabricated and matched frames described above—specifically in connection with FIGS. 10 to 12—has a useful application in the prefabrication of a new type of bridge, having external cables and a lightened section, which is based on the systematic use of prefabricated panels of low thickness which are used to produce the longitudinal and transverse beams of the deck, while the upper and lower connecting slabs are cast in a second phase. The drawing clearly shows the arrangement of the panels, which are prefabricated and assembled before the castings providing a seal between the longitudinal and transverse beams, and before the casting of the upper and lower connecting slabs. The bossages required for the deflection of the external cables are constructed without difficulty together with the panels.

This novel type of deck has the following advantages:

The panels are prefabricated with horizontal formworks open at the top, which permit the use of concrete having the most appropriate degree of plasticity for achieving strengths of the order of 1000 $kg/cm^3$, if necessary. The thickness of the various elements which make up the section is that required by calculation and not by structural considerations.

The prefabricated panels can be constructed at a central workshop and transported to the site.

The deck is very light but has substantial flexural and torsional rigidity.

The formworks can easily be reused in other structures.

A number of longitudinal beams greater than two makes it possible to lighten the upper slab and facilitates the passage of the external cables.

I claim:

1. A method of prefabricating bridges and similar structures, including the formation, away from the site, of segments or blocks forming at least a portion of the structure and which are to be perfectly coupled, wherein the method comprises: fabricating endplates or frames (21, 23; 123) having a shaped surface (25; 125) in order to form, in two contiguous blocks or segments, matched coupling surfaces for perfect in situ coupling; arranging a plurality of spaced endplates or frames in a formwork apparatus (17; 19) for concrete castings; casting, in said apparatus, a plurality of contiguous blocks or segments, each incorporating an endplate or frame (21; 23; 123) at both ends, and each having an end surface (25) perfectly matched with the abuting surface of the contiguous block or segment, the casting being carried out continuously, without the need for interruptions; and placing the various segments thus formed in situ in the same relative positions in which they are formed in the formwork apparatus.

2. The method as claimed in claim 1, wherein one of the matched surfaces (125) of the contiguous blocks or segments is formed by being prefabricated on the endplate or frame (123), and the other is formed by the casting (134) so as to become contiguous with the shaped surface of said endplate or frame (123).

3. The method as claimed in claim 1, wherein, elements (29; 30) are used to form said segments or blocks, in situ castings being limited to portions (32, 24) in zones contiguous to the end plate or frames (21; 23; 123) which incorporate projecting reinforcements.

4. The method as claimed in claim 1, wherein the formwork apparatus (17, 19) is deformed from time to time—elastically or by means of spacers between the components thereof, and is aligned by screwed supports (15) to correspond to the alignment of the structural portion to be prepared with the segments molded by continuous casting in said apparatus.

5. An apparatus for forming, away from the site, segments or blocks constituting at least a portion of a bridge or a similar structure of their intended use, wherein said apparatus corresponds in length to at least a portion of the length of the structure to be produced, and includes means for receiving a plurality of prefabricated frames or endplates intended to be incorporated into ends of contiguous segments to be formed in said apparatus, and means for receiving internal formwork portions to define the individual segments to be formed.

6. The apparatus as claimed in claim 5, wherein the apparatus comprises a plurality of individually adjustable support elements in order to impose, controlled deformations of said apparatus, to achieve an alignment of at least a portion of the structure to be produced with the segments created in said apparatus.

7. A prefabricated frame endplate or (21; 23; 123) for forming a bridge or similar structure, comprising a framed endplate element having a dimension at least equal to that of the lateral cross-section of a segment or block, and a reinforcement (26) projecting outwardly from said endplate element and incorporated into a casting of said segment or block formed away from the site from which an end thereof is formed, said endplate element including a surface contour (25; 125) in order to form a first matching surface for coupling said segment to a contiguous segment; a second matching surface created on said contiguous segment; said first matching surface fittingly contacting said second matching surface 8. A prefabricated frame or endplate according to claim 7, wherein said matching surfaces (25) provide two endplates or frames, said second matching surface being formed with a mold based on said first matching surface which was formed previously, said two endplates or frames (21; 23) being capable of being placed as a pair in a formwork apparatus in order for each of said two endplates or frames to be incorporated into the end of one of said segment and said contiguous segment cast in said apparatus, one contiguous to the other.

9. A segment or block formed, away from the site, for producing a bridge or other structure with a plurality of such segments, wherein the segment or block comprises; a prefabricated endplate provided at least at one end of said segment or block for coupling with a contiguous segment in situ, said prefabricated endplate or frame (21; 23; 123) being incorporated in said segment forming a first matched surface thereto for coupling with a contiguous segment in situ.

10. The segment or block as claimed in claim 8, wherein both ends of said segment or block thereof incorporate a prefabricated endplate or frame (21, 23).

11. An arrangement apparatus for prefabricating bridges and similar structures, comprising: a plurality of prefabricated endplates or frames, each of said endplates or frames having a shaped surface; a mold in the form of a framework apparatus for concrete castings, said plurality of endplates or frames being spaced apart in said framework apparatus; and a plurality of contiguous blocks or segments formed in said framework apparatus, each of said plurality of contiguous blocks or segments incorporating one of said endplates or frames at one both ends thereof and formed having an end surface which is substantially an exact duplicate of an abutting surface of a contiguous block or segment, said blocks or segments being positioned in situ in the same relative position in which they were formed in said framework apparatus.

12. An apparatus according to claim 11, wherein said framework apparatus includes means for receiving said plurality of prefabricated frames or endplates and for receiving internal framework portions to define an individual segment to be formed.

13. An apparatus according to claim 11, wherein connected to said framework apparatus are a plurality of individually adjustable support elements for providing controlled deformations of aid framework apparatus corresponding to the alignment of a structure to be produced from said blocks or segments.

14. An apparatus according to claim 10, wherein each of said frames or endplates is dimensioned corresponding to a cross-section of said segment or block, reinforcement elements being provided which project away from said frame or endplate for incorporation into said segment or block, said matched surfaces being formed with one surface being molded as an image of another, each including said reinforcement projecting in a opposite direction to said shaped surface.

15. An apparatus according to claim 10, wherein said blocks or segments include additional prefabricated components provided therein.

* * * * *